United States Patent [19]

Atwood

[11] Patent Number: 4,828,703

[45] **Date of Patent: * May 9, 1989**

[54] METHOD FOR REPLACING PCB-CONTAINING COOLANTS IN ELECTRICAL INDUCTION APPARATUS WITH SUBSTANTIALLY PCB-FREE DIELECTRIC COOLANTS

[75] Inventor: Gilbert R. Atwood, Briarcliff Manor, N.Y.

[73] Assignee: Union Carbide Corporation, Danbury, Conn.

[ * ] Notice: The portion of the term of this patent subsequent to May 17, 2005 has been disclaimed.

[21] Appl. No.: 128,894

[22] Filed: Dec. 4, 1987

Related U.S. Application Data

[63] Continuation of Ser. No. 739,775, Jun. 3, 1985, Pat. No. 4,744,905, which is a continuation-in-part of Ser. No. 675,278, Nov. 27, 1984, abandoned, which is a continuation-in-part of Ser. No. 566,306, Dec. 28, 1983, abandoned.

[51] Int. Cl.[4] ..... B08B 5/00

[52] U.S. Cl. ..... 210/634; 134/12; 210/909

[58] Field of Search ..... 210/634, 909; 134/12, 134/22.1, 31, 109

[56] References Cited

U.S. PATENT DOCUMENTS 4,685,972 8/1987 Fowler ..... 134/12

4,744,905 5/1988 Atwood ..... 210/634

*Primary Examiner*—Frank Spear

*Attorney, Agent, or Firm*—Saul R. Bresch

[57] ABSTRACT

Method for replacing a coolant containing PCB in electrical induction apparatus having a tank containing the PCB-containing coolant, an electrical winding and porous solid cellulosic electrical insulation immersed in, and impregnated with, the PBC-containing coolant with a substantially PCB-free permanent coolant to convert said electrical apparatus into one in which the rate of elution of PCB into the PCB-free coolant is below the maximum allowable rate of elution into the coolant of an electrical apparatus rated as non-PCB comprising steps of: (a) draining the PCB-containing coolant from said tank; (b) filling the tank with an interim dielectric cooling liquid; (c) electrically operating the apparatus; (d) thereafter draining the interim dielectric cooling liquid containing the eluted PCB from the tank; (e) repeating the cycle of steps (b), (c) and (d) a sufficient number of times until the PCB elution rate does not exceed the rate of 50 ppm PCB based on the weight of the permanent coolant after 90 days of electrical operation; and (f) filling the tank with a substantially PCB-free permanent coolant.

12 Claims, 5 Drawing Sheets

METHOD FOR REPLACING PCB-CONTAINING COOLANTS IN ELECTRICAL INDUCTION APPARATUS WITH SUBSTANTIALLY PCB-FREE DIELECTRIC COOLANTS

This application is a continuation application of application Ser. No. 739,775, U.S. Pat. No. 4,744,905 filed June 3, 1985, which is a continuation-in-part application of application Ser. No. 675,278, filed Nov. 27, 1984, now abandoned, which is a continuation-in-part application of Ser. No. 566,306, filed Dec. 28, 1983, now abandoned.

BACKGROUND OF THE INVENTION

1. Field of the Invention

This invention relates to electrical induction apparatus, e.g. electric power transformers, specifically to the dielectric liquid coolants contained therein and especially to those coolants consisting of or containing as a constituent, polychlorinated biphenyl, PCB. More particularly, the present invention relates to methods for converting PCB-containing electrical induction apparatus, e.g. transformers, into substantially PCB-free transformers in order to qualify said transformers as "non-PCB transformers" under U.S. government regulations.

2. Prior Art

Because of their fire resistance, chemical and thermal stability, and good dielectric properties, PCB's have been found to be excellent transformer coolants. U.S. Pat. No. 2,582,200 discloses the use of PCB's alone or in admixture with compatible viscosity modifiers, e.g., trichlorobenzene, and such trichlorobenzene-PCB mixtures have been termed generically "askarels". These askarels may also contain minor quantities of additives such as ethyl silicate, epoxy compounds and other materials used as scavengers for halogen decomposition products which may result from potential electric arcing. ASTM D-2283-75 describes several types of askarels and delineates their physical and chemical specifications.

However, PCB's have been cited in the U.S. Toxic Substances Control Act of 1976 as an environmental and physiological hazard, and because of their high chemical stability they are non-biodegradable. Hence, they will persist in the environment and are even subject to biological magnification (accumulation in higher orders of life through the food chain). Accordingly, in the U.S., transformers are no longer made with PCB or askarel fluids. While older units containing PCB may still be used under some circumstances, it is necessary to provide special precautions such as containment dikes and maintain regular inspections. Transformers containing PCB's are at a further disadvantage since maintenance requiring the core to be detanked is prohibited, and the transformer owner remains responsible for all environmental contamination, including clean-up costs, due to leakage, tank rupture, or other spillage of PCB's, or due to toxic by-product emissions resulting from fires. To replace a PCB-containing transformer, it is necessary to (1) remove the transformer from service, (2) drain the PCB and flush the unit in a prescribed manner, (3) remove the unit and replace with a new transformer, and (4) transport the old transformer to an approved landfill for burial (or to a solid waste incinerator). Even then, the owner who contracts to have it buried still owns the transformer and is still responsible (liable) for any future pollution problems caused by it.

Liquid wastes generated during replacement must be incinerated at special approved sites. Thus replacement of a PCB transformer can be expensive, but more importantly, since most pure PCB or askarel transformers are indoors, in building basements or in special enclosed vaults with limited access, it may not be physically feasible to remove or install a transformer, nor would it be desirable from an asset management perspective.

A desired approach to the problem would be to replace the PCB oil with an innocuous, compatible fluid. A number of fluid types have been used in new transformers as reported in Robert A. Westin, "Assessment of the Use of Selected Replacement Fluids for PCB's in Electrical Equipment", EPA, NTIS, PB-296377, Mar. 1, 1979; J. Reason and W. Bloomquist, "PCB Replacements: Where the Transformer Industry Stands Now", *Power,* October, 1979, p. 64–65; Harry R. Sheppard, "PCB Replacement in Transformers", *Proc. of the Am. Power Conf.,* 1977, pp. 1062–68; *Chem. Week,* 130, 3, 24 (1/20/82); A. Kaufman, *Chem. Week,* 130, 9, 5 (3/3/82); *CMR Chem. Bus.,* Oct. 20, 1980, p. 26; *Chem. Eng.,* July 18, 1977, p. 57; Belgian Pat. No. 893,389; *Europ. Plastic News,* June, 1978, p. 56. Among these are silicone oils, e.g., polydimethylsiloxaneoils, modified hydrocarbons (for high flash points, e.g. RTEmp, a proprietary fluid of RTE Corp.), synthetic hydrocarbons (poly-alpha-olefins), high viscosity esters, (e.g. dioctyl phthalate and PAO-13-C, a proprietary fluid of Uniroyal Corp.), and phosphate esters. A number of halogenated alkyl and aryl compounds have been used. Among them are the liquid trichloro- and tetrachlorobenzenes and toluenes and proprietary mixtures thereof (e.g. liquid mixtures of tetrachlorodiarylmethane with trichlorotoluene isomers). Liquid mixtures of the trichloro- and tetrachlorobenzene isomers are particularly suitable because of their low flammabilities (e.g., high fire points) and similar physical and chemical properties to askarels being removed. Other proposed fluids are tetrachloroethylene (e.g. Diamond Shamrock's Perclene TG) and polyols and other esters.

Of all the non-PCB fluids, silicone oils have been the most widely accepted. Their chemical, physical, and electrical properties are excellent. They have high fire points (>300° C.), and no known toxic or environmental problems. These oils are trimethylsilyl end-blocked poly(dimethylsiloxanes):

$$(CH_3)_3SiO[(CH_3)_2SiO]_nSi(CH_3)_3 \qquad \text{Formula A}$$

wherein n is of a value sufficient to provide the viscosity, e.g., viscosity at 25° C. of about 50 centistokes. Commercial silicone oils suitable for use are available from Union Carbide (L-305), and others. In addition, U.S. Pat. No. 4,146,491, British Pat. No. 1,540,138 and British Pat. No. 1,589,433 disclose mixtures of silicone oils with a variety of additives to improve electrical performance in capacitors, transformers and similar electrical equipment, and disclose polysiloxanes with alkyl and aryl groups other than methyl.

Replacement of PCB-containing askarels in older transformers with silicone oils or one of the other substitute fluids would seem to be a simple matter, but it is not. A typical transformer contains a great deal of cellulosic insulating material to prevent electrical coils, etc., from improper contact and electrical arcing. This material is naturally soaked with askarel, and may contain from 3 to 12% of the total fluid volume of the transformer. This absorbed askarel will not drain out, nor can it be flushed out by any known means, however efficient. Once the original bulk askarel is replaced with a fresh non-PCB fluid, the slow process of diffusion permits the old absorbed askarel to gradually leach out, and the PCB content of the new fluid will rise. Thus, the new coolant becomes contaminated.

For purposes of classification of transformers, the U.S. government regulations have designated those fluids with greater than 500 ppm PCB as "PCB transformers", those with 50–500 ppm PCB as "PCB contaminated transformers", and those with less than 50 ppm PCB as "non-PCB transformers". While major expenses may be entailed with the first two classifications in the event of a spill or the necessity of disposal, the last category is free of U.S. government regulation. To achieve the last classification, the PCB concentration must remain below 50 ppm for at least 90 days, with the transformer in service and sufficiently energized that temperatures of 50° C. or higher are realized. This requires a 90-day averaged rate of elution of about 0.56 ppm/day. It is anticipated that most, if not all, states of the U.S. will adopt regulations which may be the same as, or stricter, than U.S. government regulations. More lenient regulations may be possible elsewhere.

There are a number of commercial retrofill procedures on the market including those described in "The RetroSil PCB Removal System", Promotional literature of Dow Corning Corp., #10-205-82 (1982), and trade literature of Positive Technologies, Inc. on the Zero/PC/Forty process. These utilize initial clean-out procedures of as high efficiency as possible during which the electrical apparatus is not in operation. Most include a series of flushes with liquids such as fuel oil, ethylene glycol, or a number of chlorinated aliphatic or aromatic compounds. Trichloroethylene is a favorite flush fluid. Some processes, such as the Positive Technologies, Inc. Zero/PC/Forty process use a fluorocarbon vapor scrub alternating with the liquid flushes. When the initial clean-out procedure is complete, the transformer is filled with silicone fluid. As effective as these elaborate flushing procedures might have been expected to be, they cannot remove PCB adsorbed into the interstices of the cellulosic material. Consequently, the PCB content of the silicone coolant gradually rises as the residual PCB leaches out while the transformer is in use. Therefore, if one wishes to reach a PCB-free state ("non-PCB" as defined by U.S. government regulation), it is necessary to either periodically change-out, or continually clean up, the silicone fluid until a leach rate of less than 50 ppm for 90 days is reached.

Periodic change-out is very expensive, and because both the silicone and PCB are essentially non-volatile, distillation cannot be used to separate them is not practicable and other methods of separation are expensive or ineffective. Dow Corning in its RetroSil process uses a continual carbon filtration to clean up the fluid ("The RetroSil PCB Removal System", Promotional literature of Dow Corning Corp., #10-205-82 (1982); Jacqueline Cox, "Silicone Transformer Fluid from Dow Reduces PCB Levels to EPA Standards", *Paper Trade Journal*, Sept. 30, 1982; T. O'Neil and J. J. Kelly, "Silicone Retrofill of Askarel Transformers", *Proc. Elec./Electron. Insul. Conf.*, 13, 167–170 (1977); W. C. Page and T. Michaud, "Development of Methods to Retrofill Transformers with Silicone Transformer Liquid", *Proc. Elec./Electron. Insul. Conf.*, 13, 159–166 (1977)). Westinghouse in U.S. Pat. No. 4,124,834 has patented a transformer with a filtration process for removing PCB from the coolant, while RTE in European Pat. No. 0023111 has described the use of chlorinated polymers as an adsorbing media. However, the filters used in these processes are very expensive and the removal of PCB is very ineffective, due both to lack of selectivity and the very low concentrations of PCB being filtered. In lieu of filtration, procedures have been proposed involving decantation (U.S. Pat. No. 4,299,704) which is impractical due to solubility limitations, and only good at high concentrations; extraction with polyglycols (F. J. Iaconianni, A. J. Saggiomo and S. W. Osborn, "PCB Removal from Transformer Oil", EPRI PCB Seminar, Dallas, Tex., Dec. 3, 1981) or with supercritical $CO_2$ (Richard P. deFilippi, "$CO_2$ as a Solvent: Application to Fats, Oils and Other Materials", *Chem. and Ind.*, June 19, 1982, pp. 390–94), and chemical destruction of the PCB's with sodium (British Pat. No. 2,063,908). None of these schemes have been found to be economically or commercially practical for askarel transformers. However, the filtration scheme could be a reasonably effective, though expensive, procedure if it were not for the fact that the leach rate is so slow that it could take many years to reduce the residual PCB to a point where the final leach is reduced to an acceptable value (Gilbert Addis and Bentsu Ro, "Equilibrium Study of PCB's Between Transformer Oil and Transformer Solid Matrials", EPRI PCB Seminar, Dec. 3, 1981).

The problem and its cause are discussed in L. A. Morgan and R. C. Ostoff, "Problems Associated with the Retrofilling of Askarel Transformers", IEEE Power Eng. Soc., Winter Meeting, N.Y., N.Y., Jan. 30–Feb. 4, 1977, pap. A77, p. 120–9. The solubility of a typical silicone oil in PCB is practically nil ($<0.5\%$) at temperatures up to and over 100° C., while the solubility of PCB in the silicone ranges from only 10% at 25° C. to 12% at 100° C. While this limited solubility does not restrict the bulk silicone from dissolving the available five PCB, it does restrict the ability of the PCB to diffuse from the pores or interstices of the cellulosic matter.

Within any given pore filled with PCB, diffusion of PCB out must be accompanied by diffusion of silicone in. At some point within the pore there must exist an interface between the PCB and the silicone, across which neither material can very rapidly diffuse. Because the PCB is more soluble in the silicone than the reverse, the PCB will slowly diffuse into the silicone while the interface advances gradually into the pore. The limited solubility restricts the rate of diffusion and while this mechanism can eventually clean the pore of PCB, it is orders of magnitude slower than if the two fluids were miscible. The high viscosity of the silicone (and many other coolants) is also an inhibiting factor. The result is a long drawn-out leach period of perhaps several years, during which the silicone must be continually filtered or periodically replaced to remove PCB's from it. Thus, the slow leaching of PCB's out of the solid insulation by the silicone is worse than no leaching at all since the dangers of a spill of PCB-containing materials will persist over a period of years. Experimental studies by Morgan and Osthoff showed, for example, that effective PCB diffusivities into a typical silicone oil were only 1/10 of those into a 10 centistoke hydrocarbon oil. Although one might prefer, then, to retrofill with such a hydrocarbon oil, if it were not for the fire hazard of hydrocarbons, there still also is the problem of separating the PCB from the contaminated hydrocarbon oil which is high boiling like the PCB and like the silicone oil.

The present invention is based on the fact that there are suitable cooling fluids which are more suitable than silicone oil for operation over a limited time while leach is being accomplished. They are reasonably volatile for distillation from PCB, readily miscible therewith, and of relatively low viscosity for rapid diffusion into the pores of the insulation. The other constituents of askarel, i.e., trichlorobenzene and tetrachlorobenzene, are found to be ideal fluids for this purpose. They can be used as temporary or interim, leaching, cooling fluids where fire may be a potential hazard, while light hydrocarbons could be used if fire is not a hazard.

No prior art has been found to disclose the concept of producing a substantially PCB-free transformer by removing, flushing and eluting askarels from transformers containing same with an interim dielectric liquid or the steps of filling the transformer tank with an interim dielectric cooling liquid that is miscible with the PCB contained by the transformer tank, capable of penetrating said electrical insulation and capable of being separated from the PCB or the step of electrically operating the transformer while eluting PCB with an interim dielectric liquid and continuing the electrical operation for a period sufficient to elute the PCB impregnated in the solid insulation into the interim dielectric cooling liquid, draining the PCB-laden interim coolant, repeating the cycle of filling with fresh interim coolant, electrically operating and draining a sufficient number of times until the elution rate of PCB drops below the rate of 50 ppm, based on the weight of the permanent coolant to be used, after 90 days electrical operation, whereafter the coolant then is drained from the transformer and thereafter separated from the PCB contained by it thus permitting filling of the tank with a PCB-free permanent dielectric cooling liquid which remains substantially PCB-free during subsequent electrical operation.

SUMMARY OF THE INVENTION

The present invention is based upon the use of a suitable temporary or interim cooling liquid as a substitute for PCB-containing coolants in electrical induction apparatus, e.g. transformers, having a vessel, (e.g., tank) containing the coolant and an electrical winding and porous solid cellulosic electrical insulation immersed in and impregnated with PCB while electrically operating the transformer for a sufficient period of time to elute the PCB from the solid electrical insulation contained in the transformer. During the period of operation, the interim dielectric cooling liquid is changed to speed up the elution process, the preferred goal being to elute so much of the leachable PCB that the transformer can be operated for 90 days and not exceed 50 ppm PCB content in the permanent coolant intended for the transformer. After the amount of leachable PCB in the transformer has been reduced to this desired degree, the interim dielectric cooling liquid is removed from the tank and the tank is then filled with a PCB-free permanent dielectric cooling liquid compatible with the transformer. The following describes a procedure according to this invention by which a PCB-containing fluid in a transformer is replaced with a permanent PCB-free liquid coolant:

(1) The transformer is shut down (de-energized) and the PCB-containing fluid drained and disposed of in accordance with environmentally acceptable procedures. The transformer may be flushed with a flushing fluid, e.g., trichlorobenzene or trichloroethylene, liquid or vapor, to remove "free" PCB fluid.

(2) The transformer is filled with a temporary or interim cooling fluid, such as, trichlorobenzene, TCB, or a mixture thereof with tetrachlorobenzene, which is miscible with or dissolves PCB and is capable of penetrating into the pores of the electrical insulation and which is also capable of being readily separated from the PCB, and electrical operation is restored.

(3) The fluid temperature is monitored, and if the electrical loading of the transformer does not provide sufficient fluid temperature to provide the desired rate of PCB elution, thermal lagging or even external heating can be provided. Circulation of the fluid through an external loop and pump for the purpose of heating same, or for augmenting the internal circulation, may als be provided.

(4) The rate of PCB elution into the interim cooling fluid can be determined by periodic sampling and analysis. The accumulated PCB is periodically removed by removing the interim cooling fluid containing the PCB and distillation of the interim cooling fluid, e.g., trichlorobenzene (TCB) from the PCB. This may be done by shutting down, de-energizing, the transformer, draining the old fluid for distillation, and replacing with fresh interim cooling fluid, e.g., TCB. Alternatively, the transformer may be left operational while fresh interim cooling fluid, e.g., TCB, is added and old TCB removed via a slip stream or circulation loop.

(5) The PCB-contaminated TCB fluid is distilled to provide an essentially PCB-free TCB distillate, and a bottom product of PCB contaminated with TCB. The PCB may be disposed of according to approved U.S. government procedures, e.g., by incineration.

(6) When the elution rate of PCB reaches the desired level, preferably less than 50 ppm PCB based on the weight of the intended permanent coolant for a period of 90 days (e.g., an elution rate of 5/9 ppm per day), the permanent retrofill may be accomplished. The transformer is shut down (de-energized), drained, and filled with the silicone oil or other permanent cooling fluid compatible with the transformer. It is then returned to service.

(7) In order to meet U.S. government regulations for "non-PCB" transformers, analysis should show a PCB content of less than 50 ppm PCB (based on the weight of the intended permanent coolant) after a period of 90 days, after which the transformer is reclassified as PCB free, (i.e. "non-PCB").

Figure 1:
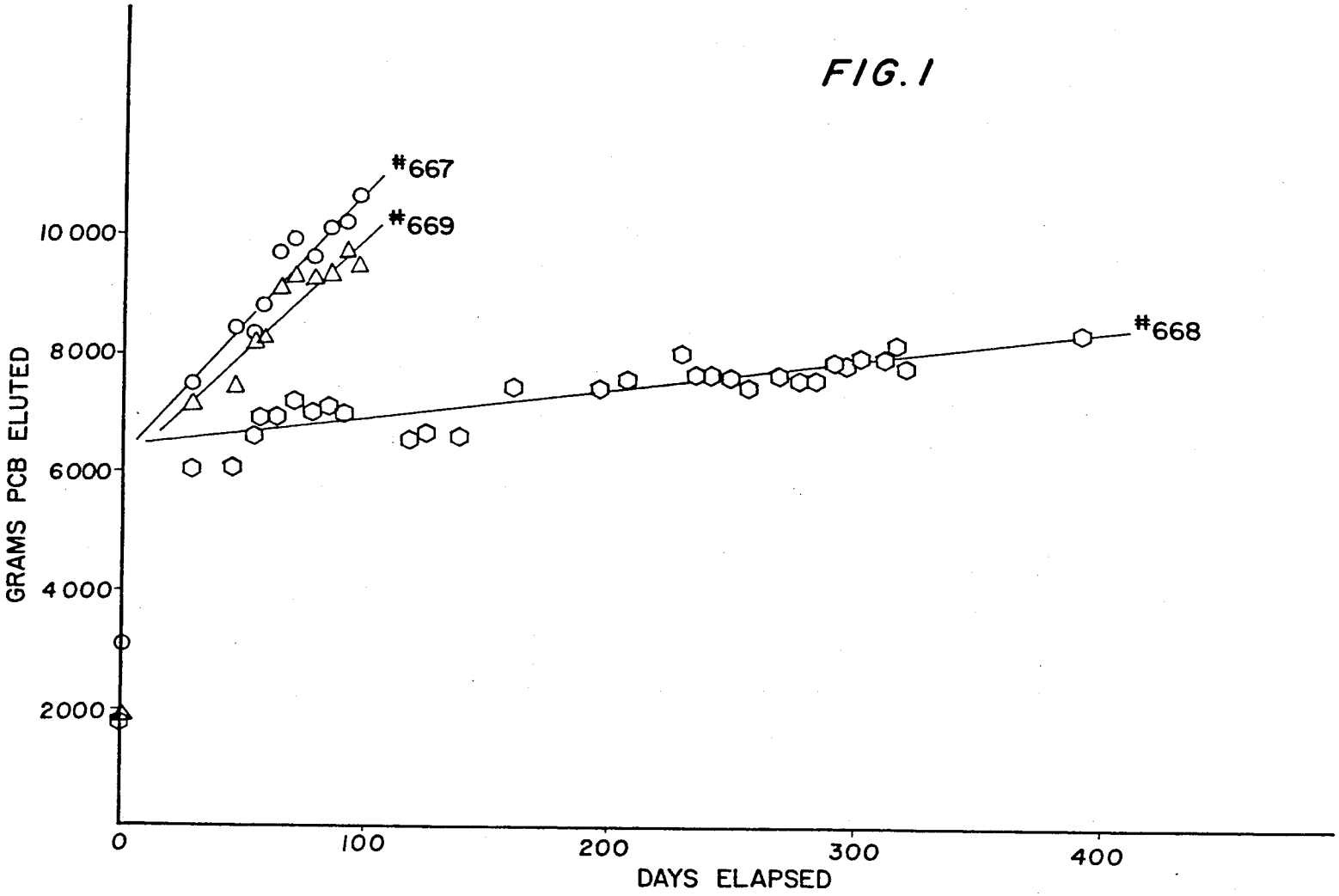
FIG. 1 contains plots of grams of PCB eluted on the vertical scale vs. days elapsed on the horizontal scale for transformers #667, #668 and #669 in Examples C, B and 2, respectively.

With respect to the flushing step, while efficient draining and flushing techniques should be used, these do not in themselves constitute the invention, but are a part of all heretofore known retrofill procedures. They are a prelude to the most efficient embodiment of the invention itself, but their value heretofore has been overrated, in that it is the slow leach rate, not the efficiency of flush which has been found to limit the rate of PCB removal. A wide variety of solvents may be used in the flushing step, including hydrocarbons such as gasoline, kerosene, mineral oil or mineral spirits, toluene, turpentine, or xylene, a wide range of chlorinated aliphatic or aromatic hydrocarbons, alcohols, esters, ketones, and so forth. However, from a materials handling standpoint and PCB separation logistics, it is practical to avoid using any more chemical types than necessary, so that the use of the intended temporary leach fluid, e.g., TCB or mixtures thereof with tetrachlorobenzene, as the initial flush is most practical.

Fluids other than normally liquid trichlorobenzene, TCB, or a mixture thereof with tetrachlorobenzene, can be used. The preferred interim fluid has the following characteristics: (a) it is compatible with PCB (i.e. preferably dissolving at least 50% of its weight of PCB, more preferably, at least 90% of its weight of PCB and, most preferably, being miscible in all proportions with PCB); (b) it is of low enough molecular weight to have good molecular mobility to be able to enter the pores or interstices of the solid insulating material and it promotes rapid mutual diffusion, preferably, having a viscosity at 25° C. of 10 centistokes or less and, more preferably, 3 centistokes or less; (c) it can be easily separated, e.g., distilled, preferably, having a boiling point of 275° C. or less and, more preferably, 260° C. or less, from PCB; (d) it is presently considered environmentally innocuous; and (e) it is compatible with typical transformer internals. While TCB, or mixtures with tetrachlorobenzene, is preferred, a number of alternatives, as above-mentioned can be used. These would include modified and synthetic hydrocarbons, and a variety of halogenated aromatic and aliphatic compounds. There are also a variety of liquid trichlorobenzene isomer mixtures. The preferred TCB fluid would be a mixture of these isomers with or without tetrachlorobenzene isomers. The advantage lies in the fact that such a mixture has a lower freezing point than do the individual isomers, thus reducing the chance of it solidifying within the transformers in very cold climates. Further, the mixtures are often the normal result of manufacture and hence can cost less than the separated and purified individual isomers.

Because the preferred objective here is to leach out the PCB at the fastest practical rate, the preferred embodiment involves operating the transformer to obtain the fastest possible diffusion rates as specified in step (3) above. When used at its full rated loading, a transformer should automatically provide enough heat for this purpose. However, since many transformers are operated below their rated loading, and below the rated safe temperature, sufficiently elevated temperatures (e.g. at least 50° C.) might not be achieved without thermal lagging or external heating. While this thermal control represents a preferred embodiment of this invention, it is optional and not an essential requirement, there being many transformers for which such lagging or heating may be impractical. Leaching at lower temperatures, even ambient, is workable but will take longer.

Fluid circulation as specified in step (3) is optional but is an advantageous embodiment in that such circulation will prevent the build-up of concentration gradients which can act to retard diffusion. Since elution is a slow process, the circulation rate need not be very rapid. Violent circulation, of course, is to be avoided in order to avoid damage to the internal structure of the transformer. It is recognized that many transformers may not, by their construction or placement, be readily modified to utilize a circulation loop, and such circulation is not considered a necessary aspect, but only one embodiment of this invention to increase elution rates. In most transformers, natural thermal gradients alone will induce sufficient circulation especially in those cases where a relatively low viscosity, moble coolant, such as TCB, is used.

As the PCB content in the TCB or other interim coolant in the transformer builds up, it can eventually reach a point where diffusion no longer serves to leach PCB from the cellulosic pores or interstices of the insulation within the transformer tank. A reduction in elution rate as determined by sample analysis, is a clue that this may be occurring. If it is determined that this is occurring, it may become necessary as specified in step (4) to replace the PCB-laden interim dielectric cooling fluid with fresh PCB-free fluid. This is most easily accomplished by shutting down the transformer, draining out the contaminated leach fluid (interim dielectric coolant), and replacing it with fresh fluid. As a practical matter, instead of monitoring the elution rate to determine when diffusion no longer serves to effectively leach PCB from the pores or interstices of the electrical insulation, it is more practical to schedule the transformer for regular coolant changes. If a non-PCB transformer is desired, coolant changes are made after selected periods of electrical operation, until the coolant fails to elute 50 ppm of PCB per 90 days operation. Periods of electrical operation between coolant changes can be selected to be 20 days to 1 year (or more, if the transformer owner's needs prevent shutting down the transformer except at rare specified times, e.g., special holiday periods, such that there may be more than one year between shutdowns and possibly shutdowns can take place only every other year.), preferably 30 to 120 days and most preferably 45 to 90 days.

The contaminated leach fluid may then be distilled off and condensed for re-use to leave a PCB bottom product which is incinerated or otherwise disposed of pursuant to U.S. government regulations. While a complete change of interim coolant is preferred, it is possible that the inconvenience of additional shutdowns predicates a different procedure, i.e., that of simultaneously introducing new fresh fluid and removing the old contaminated fluid while the transformer remains in operation. It is less efficient because the fresh fluid mixes with the old in the transformer, and fluid of reduced PCB concentration is actually removed. Thus to eliminate all the PCB, more leach fluid will have to be removed than for the preferred procedure. This penalty can be reduced if one takes pains to avoid excessive mixing. For example, new chilled TCB or other interim dielectric cooling fluid can be introduced into the bottom of the transformer, while old, warm, PCB-laden interim dielectric cooling fluid is removed from the top. The density difference will retard mixing. Regardless of the method used, the process will require repetition until the desired PCB level (e.g., less than 50 ppm in silicone oil coolant) can be maintained for at least 90 days.

While distillation is the preferred method for separating TCB or other interim dielectric coolant and PCB, other methods may be feasible, especially if fluid other than TCB is chosen as the temporary fluid. The PCB can be removed from the PCB-laden silicone oil that may result from step (7) by contacting it (e.g. on-site while step (7) is being carried out or off-site after PCB-laden silicone oil has been removed) with activated charcoal, zeolites or other adsorbants capable of adsorbing the PCB from the silicone oil. Any other method for removing PCB from the spent silicone oil can be employed.

There is some concern that TCB itself, or other chlorinated interim dielectric coolant, such as TTCB and the halogenated solvents, may eventually become suspect as a health hazard, and that the transformer, though free of PCB, will be contaminated with TCB or other potentially objectionable interim fluid. The further advantage of the procedure of this invention is that such contamination can be easily rectified if necessary, since the interim TCB or other fluid is more volatile than the silicone or heavy hydrocarbon fluids, or other relatively high viscosity permanent coolant used in the transformer and can be distilled therefrom. Accordingly, the chlorinated portion of the coolant can be replaced and the old batch sent to a still for easy purification. Two or three such changes over a period of several months will give a substantially halogen free system, if one is desired.

Other preferred coolants of a permanent nature that can be used in place of the final fill of silicone oil include dioctylphthalate, modified hydrocarbon oils, e.g. RTEmp of RTE Corp., polyalphaolefins, e.g. PAO-13-C of Uniroyal, synthetic ester fluids, and any other compatible permanent fluid. It is also preferred that the permanent dielectric fluid be characterized by a high boiling point compared to said interim dielectric solvent so that the interim dielectric solvent can be separated from the permanent fluid if the need arises and also to avoid releasing permanent fluid due to volatilization in the event the transformer tank is ruptured.

While the following have been suggested, and in some cases used, as permanent dielectric fluids, they are less preferred than the relatively high viscosity, high boiling permanent dielectric fluids: tetrachlorodiaryl methane with or without trichlorotoluene isomers, freon, halogenated hydrocarbons, tetrachloroethylene, the trichlorobenzene isomers and the tetrachlorobenzene isomers. The trichlorobenzene isomers, the tetrachlorobenzene isomers, and mixtures thereof have high flammability ratings and other physical properties similar to askarel and therefore are preferred amongst the less preferred permanent fluids.

The following examples are presented. In the examples, the following abbreviations have been used.

TCB trichlorobenzene

TTCB tetrachlorobenzene

TCB mix 30–35 wt. % tetrachlorobenzene, TTCB, in trichlorobenzene, TCB (containing an effective amount of a chlorine scavenging epoxide-based inhibitor)

PCB polychlorinated biphenyls ppm parts of PCB or TCB mix per million of coolant based on weight Askarel Askarel Type A, 60 wt. % Aroclor 1260, 40 wt. % TCB Aroclor 1260 polychlorinated biphenyl containing 60 wt. % chlorine L-305 A silicone oil within the scope of formula A above, having a viscosity of 50 centistokes at 25° C.

A "cycle" is the period of time between changes in the coolant. A "part" of a cycle is a portion of a cycle where the leach rate into the coolant is markedly different from the rate in the earlier or later portion of the cycle.

EXAMPLES 1, 2, 3, A, B AND C

Table 1 gives summary data for six transformers. The transformers for Examples 1, 2 and A, designated as #461, #459 and #460 respectively, are a bank of three identical Uptegraff transformers of 333 KVA capacity and electrically connected such that the load is equally distributed. Each of these transformers contained about 159 gallons of mineral oil (Exxon Univolt inhibited oil, transformer grade). They had at one time been askarel filled, and subsequently switched to mineral oil; hence they contained the initial residual PCB levels shown in the table. The transformers for Examples 3, B and C, designated as #669, #668 and #667 respectively, are a similar bank of three identical transformers of 333 KVA capacity, and similarly connected, but in this case are Westinghouse transformers, and contained about 190 gallons each of Type A askarel (60% Aroclor 1260 and 40% TCB). These transformers (669, 668 and 667) were expected to be about the most difficult to leach since they are spiral wound transformers in which the paper insulation, and hence diffusional path length can be several inches in depth. In contrast, many transformers are of the pancake design in which path lengths will be less than an inch.

All six transformers were drained, then spray rinsed and refilled with the coolant as shown in the Table for cycle 1. The Table also shows temperatures of the fluid during the leach cycles. The normal load required of these transformers was far below their rated capacity, and thus the normal temperatures of operation were low (50° C. or less). Higher temperatures were achieved by insulating the external surfaces of the cooling fins and in some cases wrapping them with heating tapes. During the periods of leaching in each example, the transformers were energized and operated normally. Only for the purpose of draining, rinsing, and refilling were they temporarily deenergized. Of the following Examples, 1, 2 and 3 represent the present invention, while Examples A and C illustrate slight deviations therefrom, and the consequences thereof, though correctable. Example B represents prior art.

In the case of Example 1, #461, the transformer was drained, rinsed with TCB-mix and refilled with TCB-mix. Samples of the coolant were periodically analyzed to follow the progress of the leaching. It was observed in this and other examples that the apparent leach rate was high at the start of the cycle (especially for cycle 1), and Table I shows PCB concentration levels and leach rates for different parts of the cycle. It is presumed that the early high leach rates are due partly to undrained residual liquor, because of the difficulty of draining and rinsing efficiently, and due partly to the rapid leaching of the less tightly bound or less deeply absorbed PCB. On day 68 of Example 1, the TCB-mix coolant was drained, and the transformer was refilled with the same drained coolant. For this reason, the data for cycle 1 of this particular transformer are separated into three parts in Table I. On day 164, the coolant was drained and the transformer was rinsed and refilled with fresh TCB-mix. An initial rapid rise in the first 11 days reflected the residue liquor which could not be easily drained or rinsed. However, the leach rate slowed down, and in the 2nd part of the cycle was 0.24 ppm PCB/day, below the 0.55 ppm/day maximum necessary for reclassification. Thus, on day 284 of the process, the transformer was drained, rinsed with L-305 silicone oil and refilled with L-305. In the next 92 days the PCB level reached only 11 ppm, and thus the transformer was reclassified as non-PCB according to EPA specifications. During the first two cycles of this example, the transformer was artificially heated to 85 degrees C. for the purpose of increasing the leach rates (since normal electrical loads were below rated capacity and insufficient to provide high temperatures). During cycle 3, the cycle resulting in reclassification, the artificial heating was removed, pursuant to EPA requirements.

In Example 2, #459, the interim solvent used was mineral oil instead of the TCB-mix. Mineral oil is a suitable interim solvent for those transformers which are so located that fire is not a critical hazard. It cannot be as easily separated from PCB as is TCB or TCB mix, but chemical methods are available, and solvent extraction, e.g., Fessler, U.S. Pat. No. 4,477,354, Oct. 16, 1984, is also possible. At the end of the first cycle the leach rate had been reduced to 0.32 ppm/day, and so the final coolant was introduced for the second cycle. The initial leach rate in the second cycle was high. However, the rate then decreased to a very low value, 0.09 ppm/day, and on day 290 the artificial heating and insulation was removed. After another 91 days the transformer was reclassified as non-PCB at a PCB level of only 37 ppm. It may be considered unusual to have a transformer so located that mineral oil is acceptable as an interim leaching coolant, while the final coolant is selected to be a fire resistant silicone oil. This circumstance would arise if it were intended to move the transformer to a more hazardous location or if modified operations (e.g., additional buildings) would change the hazard requirements of the present location.

Example A, #460, illustrates a case in which the interim solvent, in this case trichlorobenzene (TCB) instead of the TCB-mix, was replaced with the intended final solvent, i.e., L-305, before the chosen target rate of 0.55 ppm/day was reached. As a result the leach rate was too high to achieve reclassification with a single cycle of that final solvent. Thus, the contaminated L-305 had to be replaced with an additional cycle of fresh L-305. Example A was reclassified to non-PCB at a PCB level of 5.5 ppm after 92 days in cycle 3. Although the first batch of L-305 was contaminated, it did, however, serve to leach TCB back out of the transformer and replace it with L-305, an advantage in the event that one wishes all chlorine compounds to be minimized.

Example C, #667, was an askarel filled transformer. It, too, was drained, rinsed with TCB-mix, and refilled with TCB-mix. Initially it was not artificially heated, and averaged about 40° C. However, on the second cycle it was heated to 55° C. and on later cycles to 85° C. The beneficial effect of the heating is illustrated when the data for this transformer are compared with that for Example 3. This example also illustrates a case in which the TCB-mix interim solvent was changed over to the permanent type coolant, silicone oil, before the PCB leach rate into the TCB-mix had been reduced to the chosen target rate of 0.55 ppm/day. By so doing, we were again forced to use more than one cycle of final coolant, L-305. Three cycles of L-305 were actually used, the last being the reclassification cycle. The final PCB concentration reached after 91 days was 23 ppm, and the transformer was reclassified as non-PCB.

Figure 2:
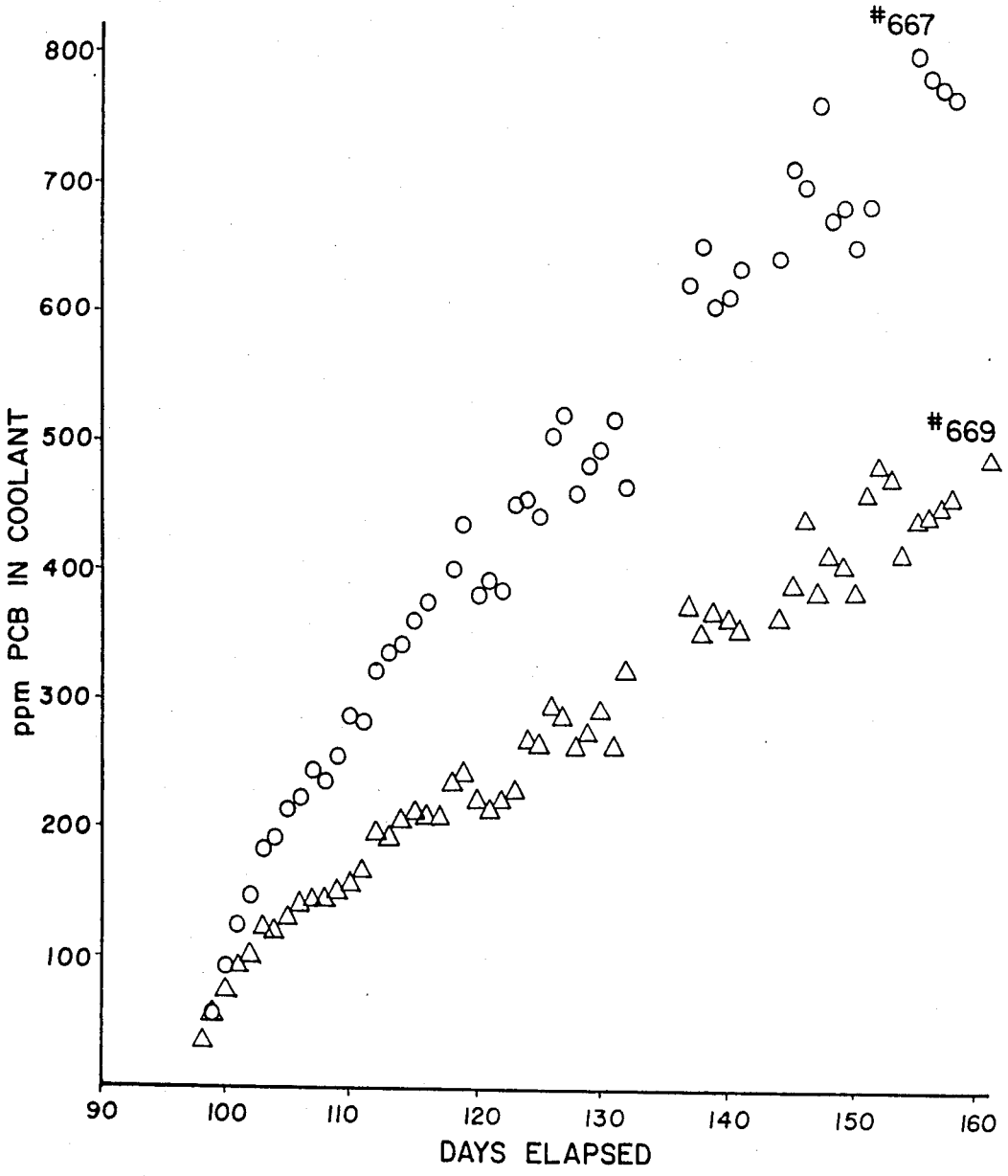
FIG. 2 contains plots of ppm PCB in the coolant of transformers #667 and #669 on the vertical scale vs. days elapsed on the horizontal scale of a heated transformer (#667) compared to an unheated transformer (#669).

Example 3, #669, is still in the process of being leached. In comparison with #667, Example C, it illustrates the effect of temperature on the leaching process. The first cycle was substantially the same for both transformers, and the slight differences in leach rates reflect predominately the differences in draining and rinsing. At the end of the first cycle, day 96, both transformers should have been at approximately the same state of leach. These transformers were located out of doors, in a north temperate climate, and, because winter was approaching, it was recognized that the leaching process might be impeded by very low temperatures. For purposes of contrast, therefore, it was decided to heat #667 (Example C) while leaving #669 subject to ambient conditions. During cycle 2, #667 was heated to approximately 55° C., while #669 during cycle 2 varied between 15° and 40° C., averaging about 23° C. FIG. 2 shows the analytical data for the second cycle. These data are quite scattered, but show clearly that the warmer transformer eluted PCB faster than the cold one by a factor of about 1.6. This factor may not be linear of course, and the rate gain may not be as dramatic for higher temperatures. However, further leaching of all experimental transformers was carried out at 85° C. whenever possible as is shown in Table I. As a consequence of the time lost for #669, as opposed to #667, in the second (and third) cycles due to lower leaching temperatures, #669 has lagged behind #667.

Example B, #668, is a comparative example, because it was drained and filled initially with final silicone coolant, L-305, instead of an interim solvent, the use of the latter being the essence of this invention. While the initial leach rate, cycle 1, 1st part, was quite high, being the result of residual undrained liquor as well as the very easy to leach askarel, the rate in the next part of the cycle was very low. FIG. 1 shows a comparison of the data, which have been converted to the actual grams of PCB removed. While about 60,000 to 70,000 grams of PCB were quickly removed (within the first 28 days), subsequent removal was much slower, and the rates are indicated by the straight lines drawn through the points. It is thus presumed that the major quantity of PCB held up in the looser insulation is easily extracted regardless of solvent, but it is the PCB held up in the tighter wound paper and the pressboard insulation which is limiting to the process, and in this case the effectiveness of the eluents differs. FIG. 1 shows this difference. While the data points are somewhat scattered due to the difficulties of precise PCB analysis, it appears that the silicone takes 400 days to remove the same quantity which the TCB mix can remove in 60 days. A comparison of the slopes of the lines shows the TCB mix to be about 8.5 to 9.0 times as effective a leachant as L-305. The key point in this invention is that the ratio of effectiveness is so high. Thus a process which might take 5 to 10 years with silicone alone could be carried out in a much shorter time with an interim coolant such as TCB mix.

TABLE I

| Ex. No. | Description | Initial PCB conc. ppm | Solvent (coolant) Used | Temp. °C. | Day Interval Start | Day Interval End | PCB Conc. at end, ppm (on L-305 basis) | Leach Rate ppm/day (on L-305 basis) |
|---|---|---|---|---|---|---|---|---|
| 1 | Transformer #461 | 7,800 | mineral oil | | | | | |
| | Cycle 1, 1st part | | TCB mix | 85 | 0 | 25 | 650 | 26.00 |
| | Cycle 1, 2nd part | | TCB mix | 85 | 25 | 68 | 820 | 3.95 |
| | Cycle 1, 3rd part | | drain TCB mix | 85 | 68 | 164 | 1,140 | 3.33 |
| | Cycle 2, 1st part | | TCB mix | 85 | 164 | 175 | 68 | 6.18 |
| | Cycle 2, 2nd part | | TCB mix | 85 | 175 | 284 | 94 | 0.24 |
| | Cycle 3 | | L-305 | var to 55 | 284 | 376 | 11 | 0.12 |
| | Reclassified to non-PCB on day 376 | | | | | | | |
| 2 | Transformer #459 | 9,150 | mineral oil | | | | | |
| | Cycle 1, 1st part | | mineral oil | 85 | 0 | 115 | 392 | 3.41 |
| | Cycle 1, 2nd part | | mineral oil | 85 | 115 | 224 | 423 | 0.28 |
| | Cycle 2, 1st part | | L-305 | 85 | 224 | 255 | 27 | 0.87 |
| | Cycle 2, 2nd part | | L-305 | 85 | 255 | 290 | 30 | 0.09 |
| | Cycle 2, 3rd part | | L-305 | var to 55 | 290 | 381 | 37 | 0.08 |
| | Reclassified to non-PCB on day 381 | | | | | | | |
| 3 | Transformer #669 | 600,000 | askarel | | | | | |
| | Cycle 1, 1st part | | TCB mix | var (40) | 0 | 50 | 11,300 | 226.00 |
| | Cycle 1, 2nd part | | TCB mix | var (40) | 50 | 96 | 13,000 | 37.00 |
| | Cycle 2 | | TCB mix | var (15–40) | 96 | 161 | 680 | 10.50 |
| | Cycle 3 | | TCB mix | 55 | 161 | 225 | 830 | 13.00 |
| | Cycle 4 | | TCB mix | 85 | 225 | 294 | 390 | 5.65 |
| | Cycle 5, 1st part | | TCB mix | 85 | 294 | 360 | 453 | 6.86 |
| | Cycle 5, 2nd part | | TCB mix | 85 | 360 | 606 | 770 | 1.29 |
| | Ongoing | | | | | | | |
| A | Transformer #460 | 25,000 | mineral oil | | | | | |
| | Cycle 1, 1st part | | TCB | 85 | 0 | 25 | 750 | 30.00 |
| | Cycle 1, 2nd part | | TCB | 85 | 25 | 162 | 890 | 1.02 |
| | Cycle 2, 1st part | | L-305 | 85 | 163 | 173 | 45 | 4.50 |
| | Cycle 2, 2nd part | | L-305 | 85 | 173 | 283 | 58 | 0.12 |
| | Cycle 3 | | L-305 | var to 55 | 283 | 375 | 5.5 | 0.06 |
| | Reclassified to non-PCB on day 375 | | | | | | | |
| B | Transformer #668 | 600,000 | askarel | | | | | |
| | Cycle 1, 1st part | | L-305 | var (40) | 0 | 28 | 8,650 | 309.00 |
| | Cycle 1, 2nd part | | L-305 | var (40) | 28 | 392 | 11,900 | 8.38 |
| | Cycle 2 | | L-305 | 85 | 392 | 539 | 1,700 | 11.60 |
| C | Transformer #667 | 600,000 | askarel | | | | | |
| | Cycle 1, 1st part | | TCB mix | var (40) | 0 | 50 | 12,000 | 240.00 |
| | Cycle 1, 2nd part | | TCB mix | var (40) | 50 | 96 | 14,600 | 56.50 |
| | Cycle 2 | | TCB mix | 55 | 96 | 161 | 1,200 | 18.50 |
| | Cycle 3 | | TCB mix | 85 | 161 | 225 | 600 | 9.38 |
| | Cycle 4 | | TCB mix | 85 | 225 | 336 | 530 | 4.78 |
| | Cycle 5 | | L-305 | 40, 85 | 336 | 390 | 180 | 3.33 |
| | Cycle 6 | | L-305 | 85 | 390 | 524 | 115 | 0.86 |
| | Cycle 7 | | L-305 | var to 55 | 524 | 615 | 23 | 0.25 |
| | Reclassified to non-PCB on day 615 | | | | | | | |

By way of further example the following illustrative cases of Examples 4–6 are presented. While they do not represent results from actual transformers, they are based upon the performance to be expected from the process of this invention under the conditions outlined below for each example as applied to transformers from which it is relatively easier to elute PCB by the process of this invention than those transformers used in Examples 1, 2, 3, A, B and C.

In each of Examples 4–6 there is used a transformer of 200 gallon fluid volume capacity, the internals of which hold up to 6 gallons in the cellulosic materials, i.e., the paper insulating the coils, and which contains 200 gallons, more or less, of an askarel of 50% PCB (500,000 ppm).

Figure 3:
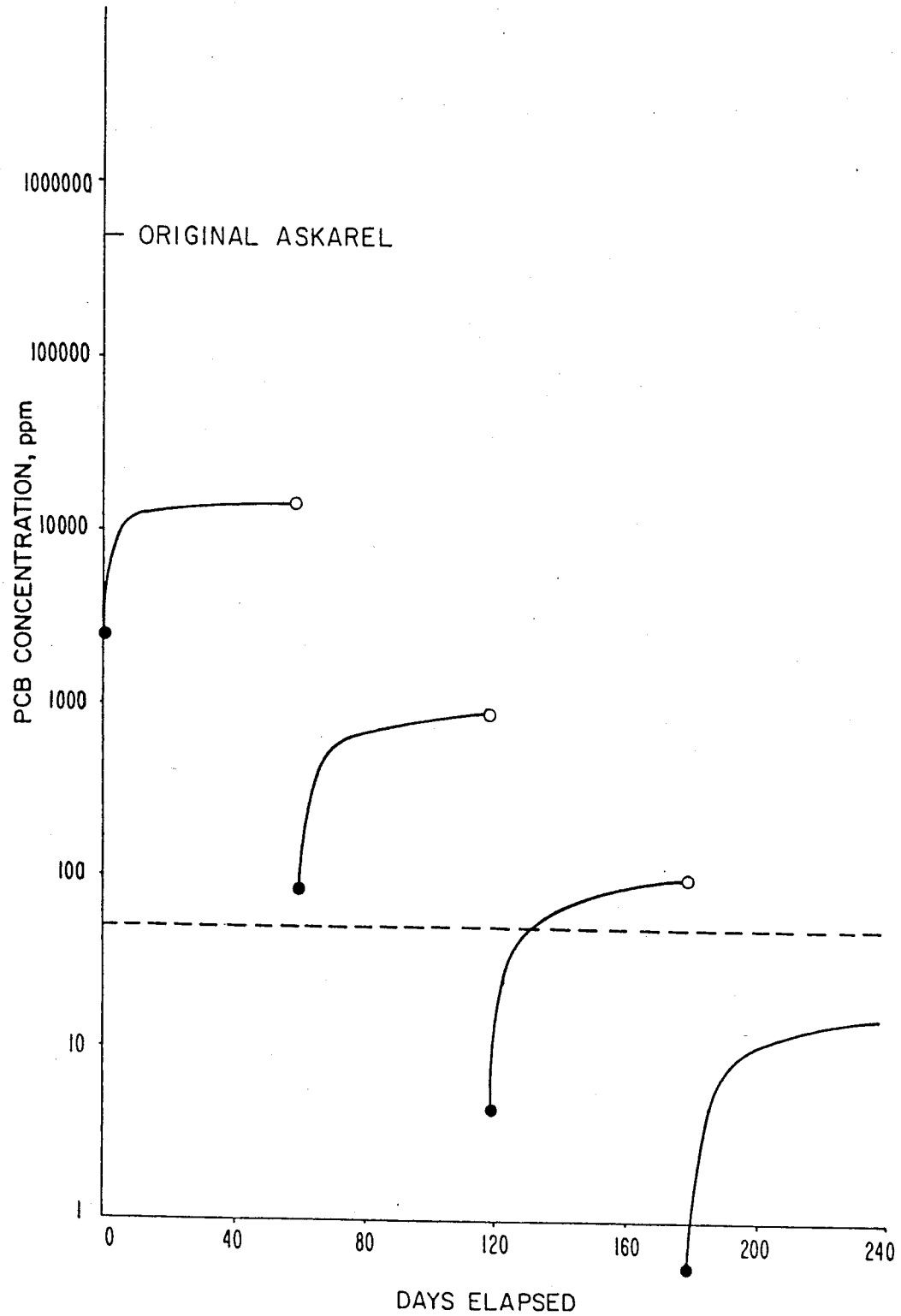
FIGS. 3–5 are plots of PCB concentration (ppm) in interim dielectric fluid in the transformer plotted on a vertical logarithmic scale vs. days elapsed on the horizontal scale.
Figure 4:
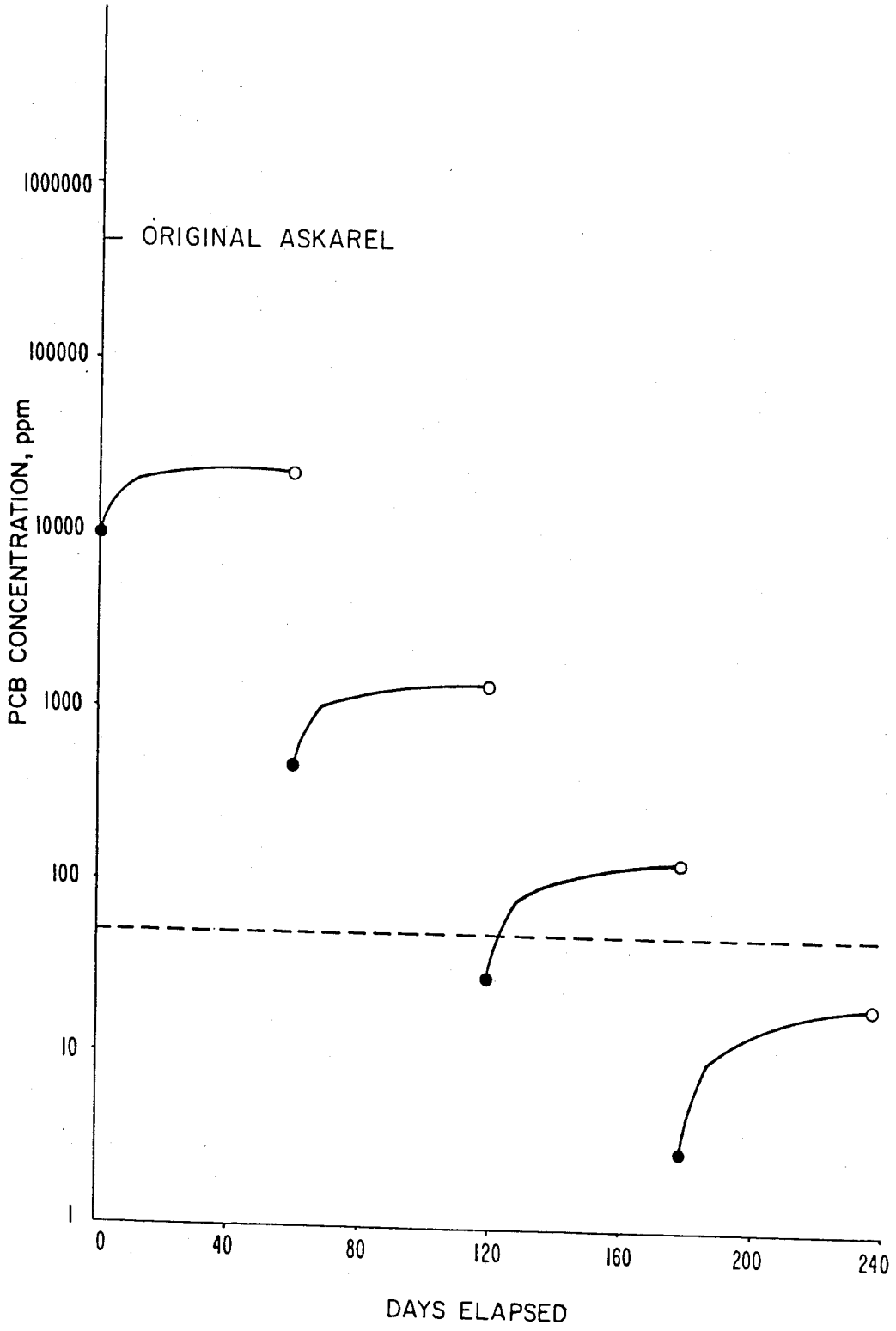
Figure 5:
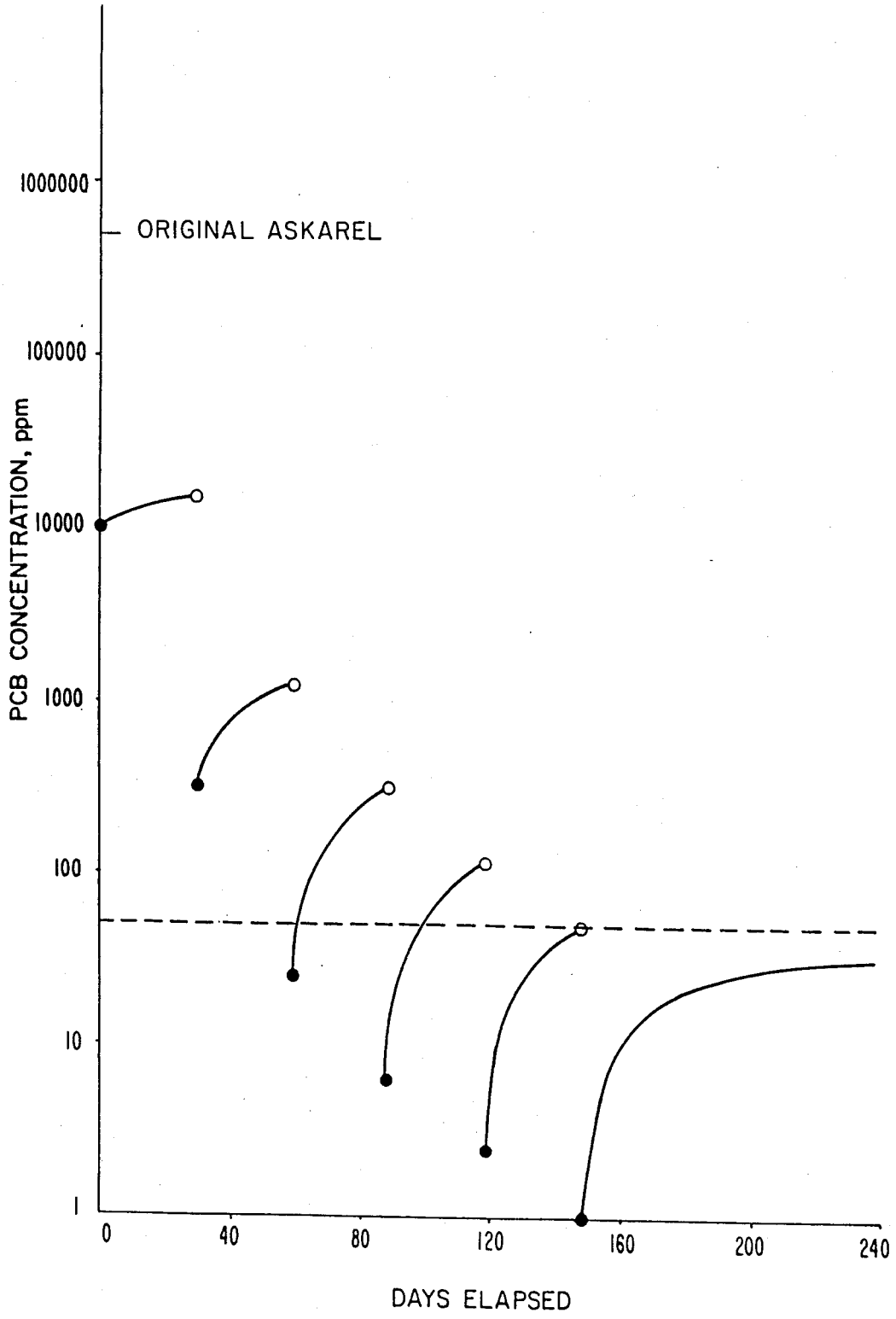

FIGS. 3 through 5 are plots of concentration of PCB in ppm in interim dielectric fluid (TCB) in the transformer plotted on a vertical logarithmic scale versus days elapsed (or soak time) and graphically illustrate the anticipated results sought to be obtained by this invention.

EXAMPLE 4

In Example 4, the transformer is first deenergized. Then it is drained of its askarel, the latter being ultimately disposed of in an approved manner. The transformer is flushed out with a small quantity (e.g. 25 gallons) of trichlorobenzene, so as to reduce the residual askarel in the free fluid system to 0.5% of its initial value. The system is then logically inspected for leaky bushings or other physical problems which may require repair at this time.

Then the transformer is filled with 200 gallons of trichlorobenzene, TCB, (or, alternatively, a trichlorobenzene-tetrachlorobenzene mixture), is sealed up, and, after appropriate testing, is reenergized. Because the flush is not totally thorough, the initial PCB level in the new fluid in the transformer is anticipated at 2500 ppm, i.e. 0.5% of the initial PCB levels. It is assumed that the PCB held up in the cellulosic materials leaches out at a rate varying from 0.001 to 0.01% per day. While these values may appear, arbitrary, they are probably attainable in easy-to-leach transformers, and higher or lower rates will only affect the length of time required to accomplish the total leach, not the basic procedure. The uppermost curve plotted on the graph marked FIG. 3 shows the concentration (on a logarithmic scale) of PCB that can be expected to be found in the transformer fluid as a function of time. In actual commercial applications of the process one would not need to determine all these concentrations. However, one would want to sample the old fluid being replaced and determine its PCB concentration. This is shown by the open circles in FIG. 3. While the exact length of the leaching periods is arbitrary, experience with a given type of transformer will indicate the most practical period lengths in terms of overall process time and total number of fluid replaements. In this example, 60 day leach periods are used.

At the end of 60 days the transformer is once more deenergized, the fluid is drained, and a sample taken for analysis. The system may be reflushed with about 25 gallons of TCB, and the flush fluid, along with the bulk fluid, is taken to a site where the TCB may be recovered by distillation (and the residual PCB properly disposed of by EPA approved methods).

The transformer is refilled with TCB, and this time the initial expected PCB concentration (due to residual prior fluid) is about 83 ppm. Again the anticipated PCB concentration follows along the second highest curve in FIG. 3 for the next 60 days (to 120 days), whereupon the TCB in the transformer is changed as before, with one exception. Since the drained TCB fluid has a concentration of PCB less than the initial value for the first fill, the drained fluid need not be sent to the still for separation, but instead can be used as the initial fill for a second PCB transformer to be converted to a non-PCB condition. This saves valuable distillation time and energy, as well as transportation or handling costs.

The refill process is repeated one more time. Table II gives a list of the anticipated analytical results which are represented by the circles on the graph of FIG. 3. It is clear from the data of Table II and FIG. 3, that the fourth refill will not rise above 50 ppm PCB content, the U.S. government cut-off value for the designation of non-PCB transformers. Therefore, at the end of 180 days, the transformer is refilled with its permanent fluid, a silicone oil, e.g., Union Carbide L-305. The PCB value expected to be reached after another 60 days (240 days) is only 16 ppm, and after the prescribed U.S. government 90 day period (270 days) it is anticipated to be at still only 18 ppm. Thus, the transformer may be reclassified as a non-PCB transformer.

TABLE II

| Days Elapsed | Concentration PCB, ppm In Drained Fluid | Initial In Refill |
|---|---|---|
| 0 | 500,000 | 2,500 |
| 60 | 16,600 | 83 |
| 120 | 896 | 4 |
| 180 Silicone Refill | 101 | <1 |
| 240 | (16) Not drained | |
| 270 | (18) Not drained | |

EXAMPLE 5

In Example 5, 60 day leach periods are used but flushing out of the transformers is eliminated. It is assumed that 98% of the fluid can be adequately drained, leaving 2% in the transformer. In this case the initial concentrations will be 2% of the previously drained fluids instead of the 0.5% of Example 4. The procedure of Example 4 is repeated in this example.

The results to be expected for Example 5 are given in Table III and are shown in the graph of FIG. 4. Note that the objective is still obtained and the system can be refilled with silicone or other permanent oil at 180 days. The lack of highly efficient flushing is expected to lead to slightly higher PCB contents in the final fluid, but this does not substantially change the achievement of the goal of a non-PCB transformer.

TABLE III

| Days Elapsed | Concentration PCB, ppm In Drained Fluid | Initial in Refill |
|---|---|---|
| 0 | 500,000 | 10,000 |
| 60 | 23,900 | 480 |
| 120 | 1,440 | 30 |
| 180 Silicone Refill | 145 | 3 |
| 240 | (21) Not Drained | |
| 270 | (23) Not Drained | |

EXAMPLE 6

The shapes of the concentration curves in FIGS. 3 and 4 might lead one to believe that the fluid changes should be made more often, e.g., every 30 days instead of 60 days. Example 6 is identical to Example 5, except that 30 day leach periods are used. The expected analytical results are given in Table IV and the plots are shown in FIG. 5. The trend is obvious from the graphs of FIG. 5. The initial refill shows a reduction almost as good as that for Example 5, but subsequently the reductions start to curve off. The sixth refill can be made with the permanent fluid, and some time has been saved, about 30 days, at the expense of the two extra refills with TCB. This example illustrates the availability of a trade-off of time vs. number of refills, and the choice depends upon which is valued the most highly for the specific case at hand.

TABLE IV

| Days Elapsed | Concentration PCB, ppm In Drained Fluid | Initial in Refill |
|---|---|---|
| 0 | 500,000 | 10.000 |
| 30 | 15,800 | 316 |
| 60 | 1,260 | 25 |
| 90 | 310 | 6 |
| 120 | 120 | 3 |
| 150 Silicone Refill | 50 | 1 |
| 180 | (21) Not Drained | |
| 240 | (32) Not Drained | |

The present invention is not limited to use in transformers but can be used in the case of any electrical induction apparatus using a dielectric coolant liquid including electromagnets, liquid cooled electric motors, and capacitors, e.g., ballasts employed in fluorescent lights.

What is clamed is:

1. A method for replacing a coolant containing PCB in an electrical induction apparatus having a tank containing said coolant, an electrical winding and porous solid cellulosic electrical insulation immersed in said PCB-containing coolant with a substantially PCB-free high boiling dielectric permanent coolant to convert said electrical apparatus into one in which the rate of elution of PCB into said coolant is below the maximum allowable rate of elution into the coolant of an electrical apparatus rated as non-PCB, said solid porous electrical insulation being impregnated with said PCB-containing coolant, said method comprising the steps of:

(a) draining said PCB-containing coolant from said tank to remove a major portion of said PCB-containing coolant contained by it;

(b) filling said tank with an interim dielectric cooling liquid that is miscible with said PCB, is sufficiently low in viscosity to circulate within said tank and penetrate the interstices of said porous solid electrical insulation, and is capable of being readily separated from said PCB;

(c) electrically operating said electrical induction apparatus and continuing said electrical operation for a period sufficient to elute PCB contained in said PCB-containing coolant impregnated in said porous solid insulation therefrom into said interim dielectric cooling liquid;

(d) thereafter draining said interim dielectric cooling liquid containing said eluted PCB from said tank;

(e) repeating the cycle of steps (b), (c) and (d), when the rate of elution of PCB into said interim dielectric cooling liquid exceeds 0.55 ppm of PCB per day based on the weight of said permanent dielectric coolant; and (f) filling said tank with a substantially PCB-free permanent coolant so as to reclassify said electrical apparatus to non-PCB status.

2. Method as claimed in claim 1 wherein said PCB-free permanent coolant is selected from the group consisting of tetrachloroethylene, trichlorobenzene, tetrachlorobenzene, and other halogenated hydrocarbons.

3. Method as claimed in claim 1 wherein, when carrying out step (d) of the previous cycle and step (b) of the next succeeding cycle, said interim cooling liquid is drained from the top of said tank while fresh chilled interim dielectric cooling liquid is fed into the bottom of said tank and while electrical operation of the apparatus is continued.

4. Method as claimed in claim 1 wherein said steps (d) and (f) are carried out by feeding said PCB-free permanent coolant into the bottom of the tank while removing the interim dielectric cooling liquid in the tank from the top of said tank, and while electrical operation of the apparatus is continued.

5. Method as claimed in claim 1 wherein said tank is provided with heat insulation in order to raise the temperature of the interim dielectric cooling liquid contained by it during each step (c) while electrically operating said electrical induction apparatus.

6. Method as claimed in claim 1 wherein said interim dielectric cooling liquid in said tank is heated during step (c) while electrically operating said electric induction apparatus.

7. Method as claimed in claim 1 wherein during step (c) said interim dielectric cooling liquid is removed from said tank, heated and returned to said tank while maintaining sufficient interim dielectric fluid in said tank and electrically operating said electrical induction apparatus.

8. Method as claimed in claim 1 wherein said interim dielectric liquid is more volatile than said PCB and is separated from said contained PCB by distilling off said interim dielectric cooling liquid.

9. Method as claimed in claim 1 wherein said interim dielectric cooling liquid containing PCB eluted from said solid insulation is drawn off from said tank as a slip stream while electrically operating said electrical induction apparatus adding fresh interim dielectric cooling liquid substantially equivalent to the amount of PCB-containing interim dielectric fluid drawn off in said slip stream.

10. Method as claimed in claim 1 wherein said tank is flushed with a solvent for said PCB following step (a) and before step (b).

11. Method as claimed in claim 10 wherein said flushing solvent is the same liquid as said interim dielectric cooling liquid used in step (b).

12. Method as claimed in claim 10 wherein said flushing solvent and said interim dielectric cooling liquid is trichlorobenzene.

* * * * *